US007628469B2

(12) United States Patent
Inoue

(10) Patent No.: US 7,628,469 B2
(45) Date of Patent: Dec. 8, 2009

(54) INK JET HEAD

(75) Inventor: Tomoyuki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 342 days.

(21) Appl. No.: 11/734,017

(22) Filed: Apr. 11, 2007

(65) Prior Publication Data

US 2007/0242108 A1 Oct. 18, 2007

(30) Foreign Application Priority Data

Apr. 12, 2006 (JP) ..... 2006-109910

(51) Int. Cl.
*B41J 2/05* (2006.01)

(52) U.S. Cl. ..... 347/56

(58) Field of Classification Search ..... 347/20, 347/40, 54, 56, 65

See application file for complete search history.

(56) References Cited

U.S. PATENT DOCUMENTS 5,719,604 A * 2/1998 Inui et al. ..... 347/54
6,137,510 A 10/2000 Sato et al. ..... 347/63
6,286,933 B1 9/2001 Murakami et al.
6,540,335 B2 4/2003 Touge et al.

FOREIGN PATENT DOCUMENTS

JP 10-146976 6/1998

* cited by examiner

*Primary Examiner*—An H Do
(74) *Attorney, Agent, or Firm*—Fitzpatrick, Cella, Harper & Scinto

(57) ABSTRACT

An ink jet head includes a plurality of energy generating elements for generating energy for ejecting an ink droplets; a substrate including an ink supply port extending in a direction, with the energy generating elements arranged on both sides of the ink supply port; a plurality of ink ejection outlets provided corresponding to the energy generating elements, respectively, to form arrays of ink ejection outlets disposed on the respective sides of the ink supply port, wherein the ink ejection amount of one array of ink ejection outlets is different from that of another array of ink ejection outlets; an ejection outlet plate portion provided on the substrate so as to be opposed to the ink supply port; a plurality of ink flow paths for fluid communication between the ink supply port and the ink ejection outlets, respectively; a beam-like projection projected from the ejection outlet plate portion toward the ink supply port so as to oppose the ink supply port; and reinforcing ribs integral with the beam-like projection and contacting the substrate. The reinforcing ribs are provided only on the side of the array of the ejection outlets which has a larger ejection amount than that of another array of the ejection outlets.

6 Claims, 10 Drawing Sheets

(a)

(b)

INK JET HEAD

FIELD OF THE INVENTION

The present invention relates to an ink jet head which discharges the ink from the ink ejection outlet and effects the recording.

RELATED ART

Recently, the demand for the high definition image formation has increased for an ink jet head, and, as for the ink jet head, it is desirable to reduce the ejection amount to increase the resolution. Therefore, in an ink jet head, an ejection energy generating element for discharging the ink is formed on a silicon substrate, and the resin material structure provided with an ink ejection outlet or an ink passage is provided so that the element thereof may be covered. This resin material structure includes a heating portion in which the heat from the ejection energy generating element is applied to the ink, and it includes an ink passage which extends to the ink ejection outlet. The resin material structure comprises a flow passage forming portion which forms the ink passage, and an opening surface through which the ink ejection outlet opens. In addition, the portion which opens downward forms a plate-like flow path ceiling. Here, the plate-like flow path ceiling is called the "ejection outlet plate portion" or "plate portion".

This plate portion made from the resin material tends to be the fragile or vulnerable against an external force because of the hollow structure thereof. In order to assure the ink ejection performance particularly, the diameters and the ink passages of the ejection outlets having a comparatively large ink ejection amount are large, and therefore, it is most vulnerable. For this reason, when the large external force is applied to the surface of the opening which comprises the ejection outlet, a crack may be produced starting at the vulnerable portion around the ejection outlet. Such an external force may be applied when the refreshing operation is performed for the surface of the opening of the ink jet head, in order to remove clogging of the ink ejection outlet, etc., to regain the normal state. This recovery process is an operation which is carried out by a main assembly of an ink jet recording apparatus, and includes a suction operation for sucking and discharging the ink from the ink ejection outlet, and a wiping operation of the opening surface by a blade, such as a rubber blade. The external force is applied by other factors. For example, in a recording material feeding means of the main assembly of the ink jet recording apparatus, when a sheet jam, etc., occurs, the recording material may contact the opening surface. In addition, when the user handles the ink jet head, the surface of the opening may be touched inadvertently. Japanese Laid-open Patent Application Hei 10-146976 proposes providing a projection 310 extended downwardly toward a back side (a side opposite from an ejection outlet surface, that is, an ink supply port 302 side surface) of a plate portion 306. This projection 310 is provided in order to avoid bubbles 309 existing in an ink supply port 302 formed through a silicon substrate 301 from closing an ink passage 308 in a flow passage forming member 305. The projection 310 from this plate portion 306 contacts with the silicon substrate 301, thereby to function also as the strength reinforcement of the plate portion 306. These projections 310 are provided midway through the ink passage 308 extended from the ink supply port 302 to the heating portion 303 (the electrothermal transducer). For this reason, although the projection is a not insignificant disturbance (flow path resistance) against the smooth ink flow 311, if the ink amount ejected is the same as the ink amount in the conventional structure, this flow path resistance is not a serious problem.

However, there is a possibility that above described flow path resistance cannot be disregarded, when the diameter of the ejection outlet 307 is made small or the ink passage 308 is made small in order to meet the demand for the higher precision image formation.

SUMMARY OF THE INVENTION

Accordingly, it is a principal object of the present invention to provide an ink jet recording head wherein a physical strength of the side having ink ejection outlets is increased.

According to an aspect of the present invention, there is provided an ink jet head comprising a plurality of energy generating elements for generating energy for ejecting ink droplets; a substrate including an ink supply port extending in a direction, with said energy generating elements arranged on both sides of the ink supply port; a plurality of ink ejection outlets provided corresponding to said energy generating elements, respectively, to form arrays of ink ejection outlets disposed on the respective sides of said ink supply port, wherein the ink ejection amount of one of said arrays of ink ejection outlets is different from that of another array of said ink ejection outlets; an ejection outlet plate portion provided on said substrate so as to be opposed to said ink supply port; a plurality of ink flow paths for fluid communication between said ink supply port and said ink ejection outlets, respectively; a beam-like projection projected from said ejection outlet plate portion toward said ink supply port so as to oppose said ink supply port; and reinforcing ribs integral with said beam-like projection and contacting said substrate, wherein said reinforcing ribs are provided only in the array of the ejection outlets which has a larger ejection amount than that of another array of the ejection outlets.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with accompanying drawings.

Figure 1:
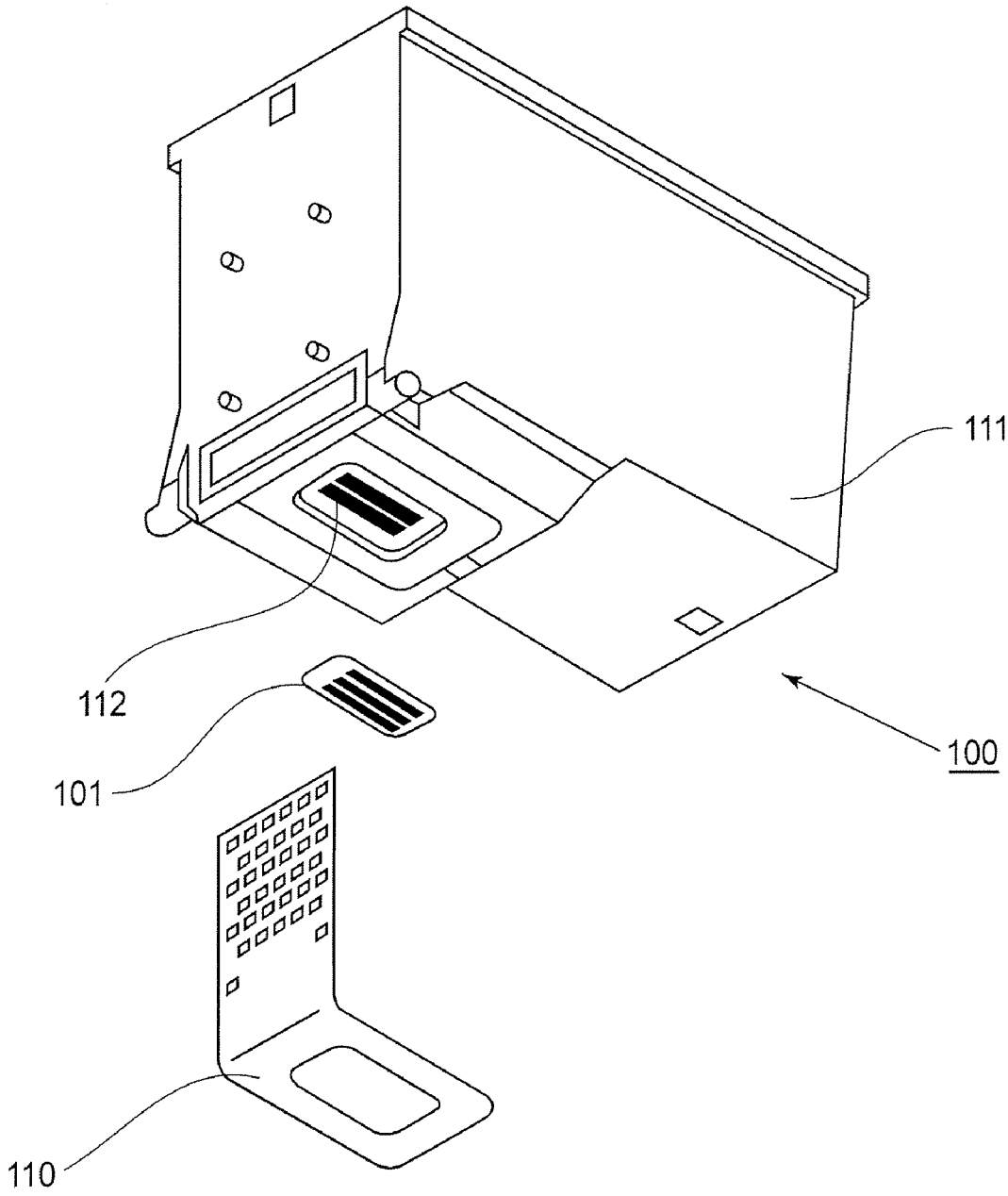
FIG. 1 is an exploded perspective view of the ink jet head according to an embodiment of the present invention.
Figure 2:
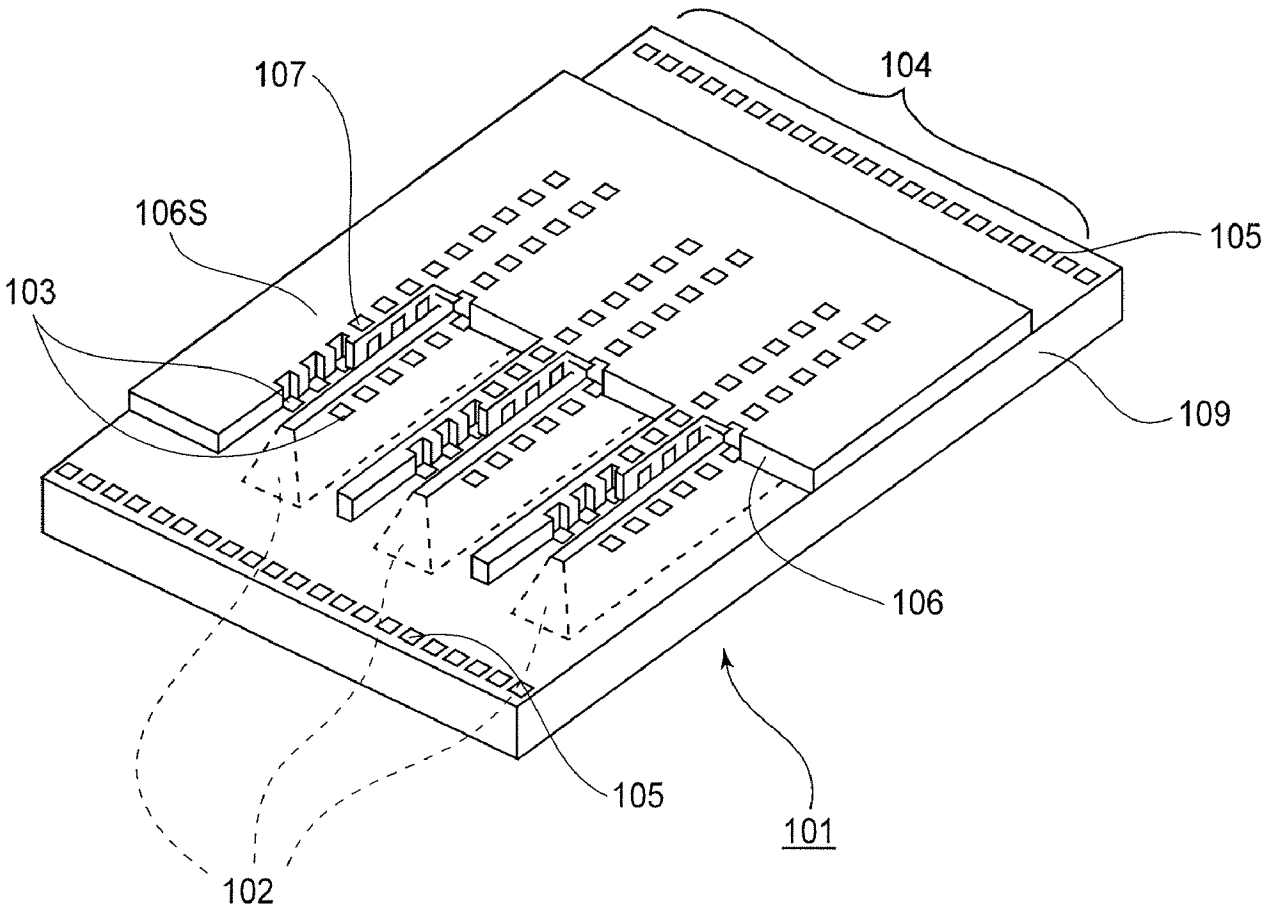
FIG. 2 is a partly exploded perspective view of the recording element substrate in ink jet head.
Figure 3:
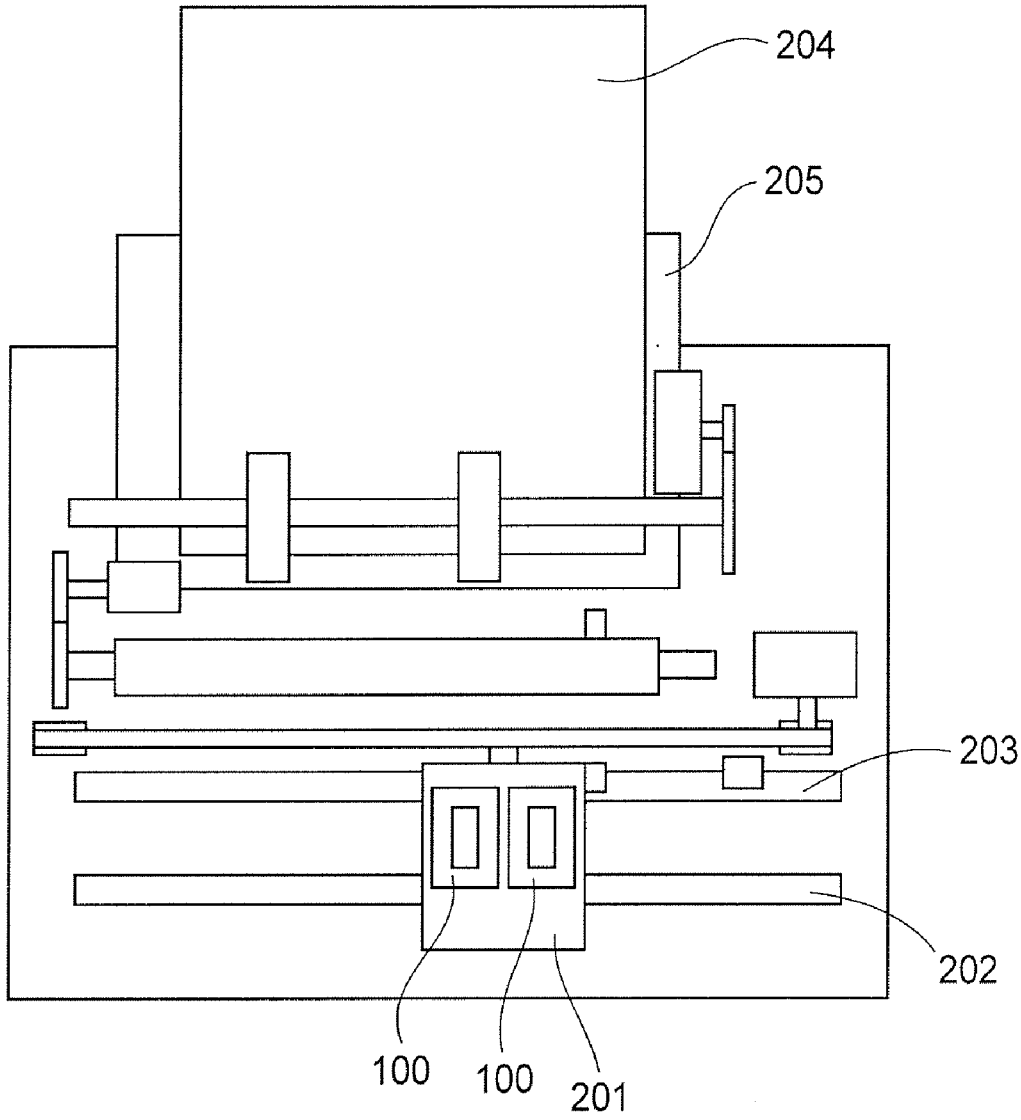
FIG. 3 illustrates an example of the ink jet recording apparatus which can be provided with the ink jet head of the present invention.

Referring to FIG. 1-FIG. 3, an ink jet head to which the present invention is implemented or applied, and the ink jet recording apparatus which is provided with this head will be described The ink jet head shown in FIG. 1 is integral with an ink container. The ink jet head in FIG. 1, the ink jet head 100 contains the color ink (the cyan ink, the magenta ink, and the yellow ink) therein. The ink jet head 100 is detachably mountable on the carriage 201 with which the main assembly of the ink jet recording apparatus shown in FIG. 3 is provided. The ink jet head 100 shown in FIG. 1 generates the bubble in the ink using thermal energy in response to the electric signal, thereby to eject the ink.

The ink jet head 100 comprises a recording element substrate 101, a wiring tape 110, and an ink retaining member 111, as shown in the exploded perspective view of FIG. 1. Each color ink is supplied to the recording element substrate 101 by way of the ink supply port 102 from the ink retaining member 111.

FIG. 2 is a partly exploded perspective view of the recording element substrate 101. The three ink supply ports 102 for the cyan ink, the magenta ink, and the yellow inks are arranged in parallel and formed in the recording element substrate 101. The heat generating element 103 and the ejection outlet 107 which are the electrothermal transducer element for generating thermal energy for ejecting the ink correspond one to one, and are disposed at the both sides of each ink supply port 102 thereof along with the one array.

The electrode portions 104, such as the electric wiring and resistance, etc., are formed on the recording element substrate 101 cut and formed from the silicon substrate, and the ink passage forming member 106 and the ejection outlet 107 are formed thereon by the lithographic technique with the resin material. The electrode portion 104 for supplying the electric power to the electric wiring is provided with electroplated-bumps 105 of Au or the like.

The ink passage formed in the flow passage forming member 106 is extended from the ink supply port 102 to the ejection outlet 107 through the portion on which the heat generating element 103 is provided, for every color. The ejection outlets 107 are opened in the outermost surface of the flow passage forming member 106. This surface is called the opening surface 106S as a surface in which the ejection outlets open. A part of flow passage forming member 106 faces with the ink supply port 102, and it has the plate-like configuration penetrated by the ejection outlets 107. This portion is called a plate portion 106P.

The recording element substrate 101 is bonded and fixed with high positional accuracy relative to the ink retaining member 111 so that the ink supply ports 102 of the recording element substrate 101 are in communication with the ink supply ports 112 of the ink retaining member 111, respectively.

A part of back side of the wiring tape 110 is bonded and fixed to the flat surface around the neighborhood of the ink supply port 112 of the ink retaining member 111. The electrical connection portion between the recording element substrate 101 and the wiring tape 110 is sealed by the sealant in order to protect the electrical connection portion from the corrosion by the ink, or an external impact.

The ink jet recording apparatus which can be loaded with the ink jet head of the cartridge type which has been described above will be described. FIG. 3 illustrates an example of the ink jet recording apparatus which can be provided with the ink jet head to which the present invention is applied.

In the ink jet recording apparatus shown in FIG. 3, the ink jet head 100 shown in FIG. 1. is positioned relative to the carriage 201, and is mounted exchangeably. The apparatus main assembly is provided with guiding shafts 202, 203 extended in the direction crossing with or perpendicular to the feeding direction of the recording material 204, and the carriage 201 is guided and supported for reciprocal movement along the guiding shaft.

The recording materials 204, such as the recording sheet and the thin plastic resin plate, are separated and supplied one by one from automatic sheet feeder (ASF) 205. In addition, the recording material 204 is fed through the position (the recording position) opposed to the opening surface of the ejection outlet 107 of the ink jet head 100.

The recording material 204 is supported by the platen (unshown) at the back side thereof in the recording position. The opening surface 106S of the ink jet head 100 mounted on the carriage 201 projects downwardly (toward the feeding path side to which the recording material 204 is fed) from the carriage 201, and in the recording position, it is retained so that it may face the recording material 204.

The ink jet head 100 is mounted on the carriage 201 so that the direction of the row of the ejection outlets 107 of each opening surface 106S may intersect relative to the direction of the scanning of the carriage 201.

The First Embodiment

The first embodiment according to the present invention will be described referring to FIGS. 4 and 5.

Figure 4:
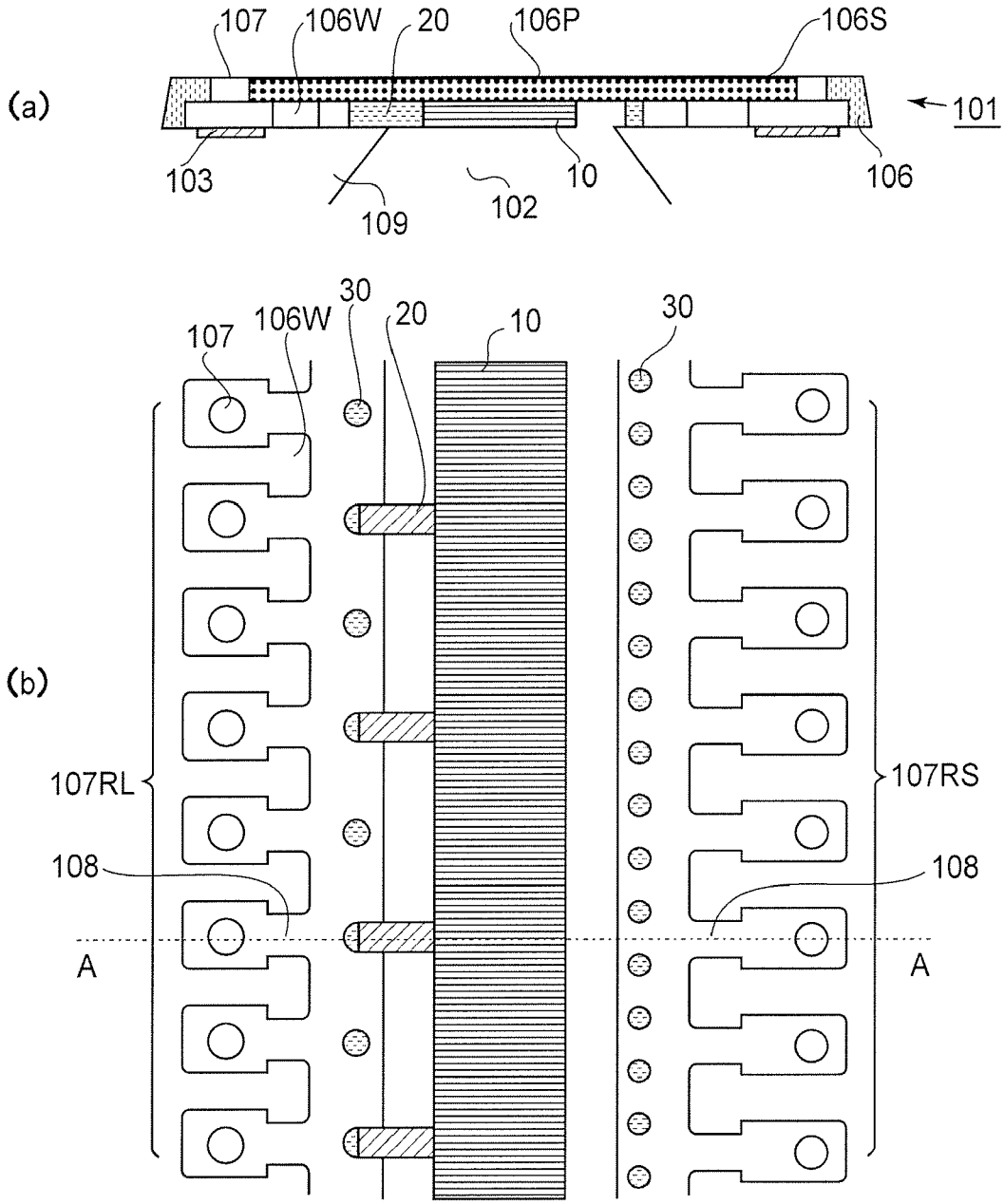
FIG. 4 illustrates an ejection outlet plate portion according to an embodiment of the present invention, wherein (a) is a sectional view taken along a line A-A, and (b) is a schematic view.

FIG. 4 illustrates a peripheral portion of an ejection outlet 107 of a recording element substrate 101 according to the first embodiment of the present invention, wherein (a) is the sectional view taken along a line A-A of (b), and (b) is the schematic perspective view thereof.

Figure 5:
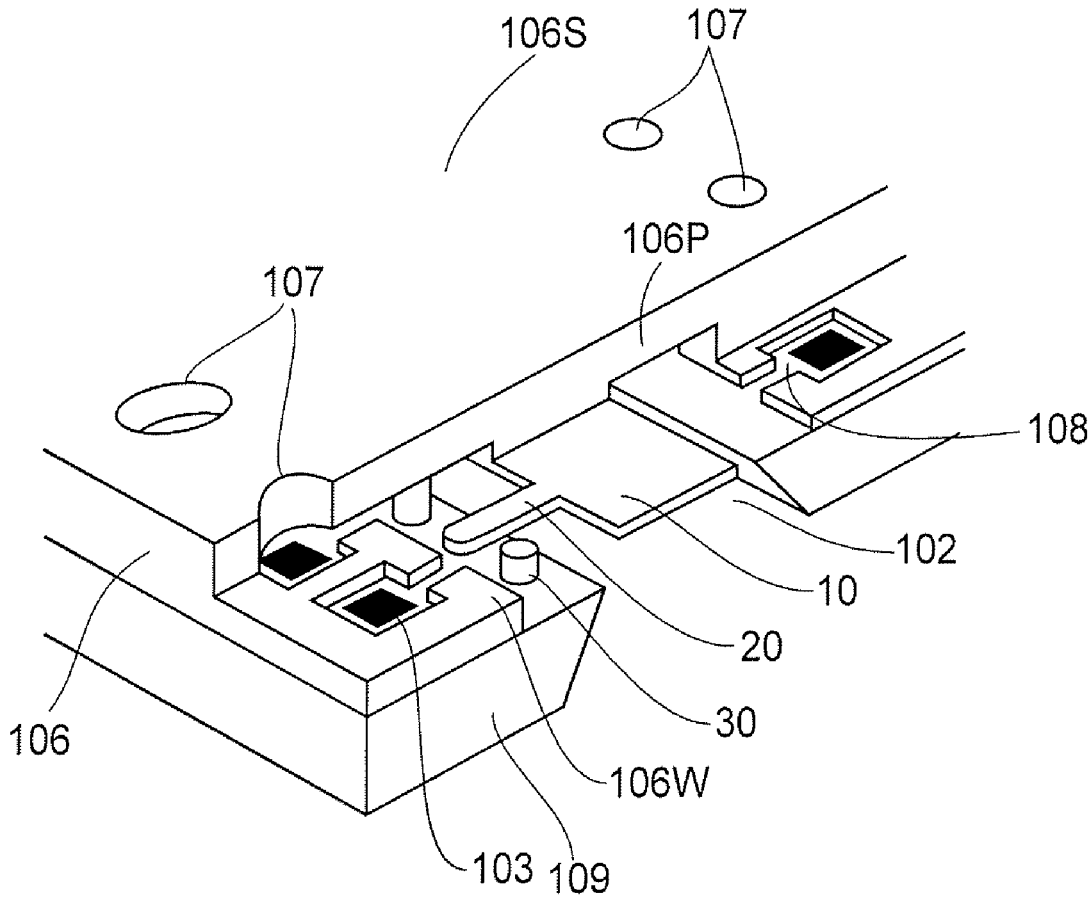
FIG. 5 is a partly exploded perspective view of a beam-like projection and a reinforcing rib of the recording element substrate in ink jet head.

FIG. 5 is a perspective view which illustrates a beam-like projection 10, and a reinforcing rib 20 and a columnar projection 30, wherein a silicon substrate 109 and a flow passage forming member 106 of a recording element substrate 101 are exploded partially.

The ink jet head 100 according to this embodiment comprises a silicon substrate 109 on which connecting lines and heat generating elements 103 are formed using the lithographic technique as an upper layer, and it further comprises isolating walls 106W, ejection outlets 107, etc., for the ink passages 108 corresponding to the heat generating elements 103. On the silicon substrate 109, an ejection outlet plate portion made of the resin material 106P, which forms a ceiling portion of a flow passage forming member 106 opened in the ejection outlets 107, is formed. It further comprises a beam-like projection 10 projected and faced toward the ink supply port 102 from the ejection outlet plate portion 106P, and a columnar projection 30 similarly projected toward the silicon substrate 109 from the ejection outlet plate portion 106P. Furthermore, from the beam-like projection 10, a reinforcing rib 20 which is integral with the beam-like projection 10 is provided between adjacent columnar projections 30, and it is projected toward the surface which forms the ink passage 108 of the silicon substrate 109. The columnar projection 30 and the reinforcing rib 20 contact the silicon substrate 109. The reinforcing rib 20 is provided so that the centerline extending toward the extension thereof may substantially overlap with the centerline of the ink flow of the ink passage 108, as shown by the line A-A of FIG. 4(*b*). Such a disposition is used to stabilize the ink ejection performance from each ink ejection outlet 107 by preventing offset of the direction of the ink inflow by the reinforcing rib 20.

The heat generating elements 103 which are the ejection energy generating elements, and the ink ejection outlets 107 are arranged on both sides along a longitudinal direction (the extending direction of the ink supply port 102) of a rectangular opening of the ink supply port 102.

The heat generating elements 103 which are the ejection energy generating elements, and the ink ejection outlets 107 are arranged on both sides along a longitudinal direction (the extending direction of the ink supply port 102) of a rectangular opening of the ink supply port 102.

The ejection amounts of the ink differ between the ejection outlet array 107RL and the ejection outlet array 107RS, more particularly, the ejection outlet array 107RL is larger in the ejection amount of the ink. In this embodiment, the ejection amount of the ink of each ink ejection outlet 107 of the ejection outlet array 107RL is 5 pico liters, and the ejection amount of the ink of each ink ejection outlet 107 of the ejection outlet array 107RS is 1-2 pico liter.

In this embodiment, the reinforcing rib 20 integral with the beam-like projection 10 is disposed at the intervals each corresponding to the two ink ejection outlets so that it may be extended toward the ink passage 108 for the ejection outlet array 107RL of the large ejection amount of the ink. The one columnar projection 30 is disposed at the portion of the silicon substrate 109 extended from the ink supply port 102 to the ink passage 108 between adjacent reinforcing ribs 20. The width of the reinforcing rib 20 and the size of the columnar projection 30 are preferably large from the viewpoint of the rigidity improvement of the ejection outlet plate portion 106P. However, this position between the reinforcing rib 20 and the columnar projection 30 is the flow path for supplying the ink to the region having the heat generating element 102 at the rate of 10,000-20,000 per second. For this reason, the reinforcing rib 20 and the columnar projection 30 have the configuration and the size which do not provide the large flow resistance against the smooth ink flow. In this embodiment, the width of the reinforcing rib 20 and the diameter of the columnar projection 30 are both 13 μm. In the ink jet head which employed this flow passage configuration, it has been confirmed that they do not have a great influence on the ink ejection performance.

The reinforcing rib 20 is not provided for the side of the array of the ink ejection outlets 107RS having a small ejection amount of the ink, and two columnar projections 30 are disposed for each heat generating element 102. This is because the ink passage structures, such as ink passage 108, the bubble generation chamber at which the heat generating element 107 is disposed, and inner diameter of the ink ejection outlet 107, are small, so that they tend to be influenced by flow path resistance, in the portion having a small ejection amount of the ink as opposed to the portion having a large ejection amount of the ink.

As shown in FIG. 5, according to this embodiment, the ejection outlet plate portion 106P bridges across the ink supply port 102, without contacting with the silicon substrate 109. The beam-like projection 10 is provided in the ejection outlet plate portion 106P faced to the ink supply port 102 which comprises the rectangular opening configuration. The ejection outlet plate portion 106P supports the portion which is not contacted to the silicon substrate 109 by reinforcing rib 20 extended from the beam-like projection 10, and columnar projection 30 projected from the ejection outlet plate portion 106P. With such a structure, the strength increases in the portion which is not contacted to the silicon substrate 109 and therefore which is vulnerable and relatively easy to destroy by the external force in the ejection outlet plate portion 106P which forms ink ejection outlet 107.

Figure 6:
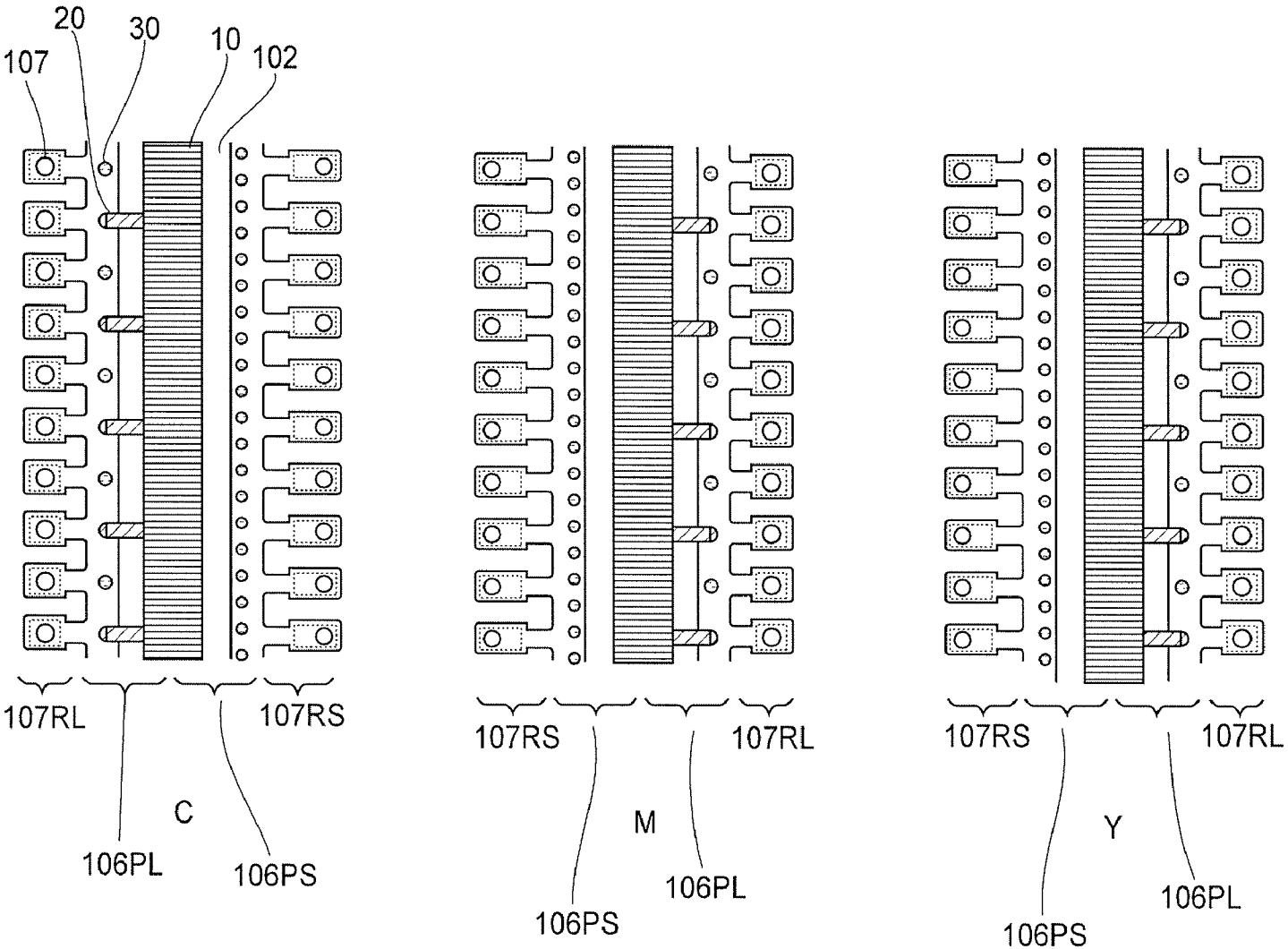
FIG. 6 is a schematic illustration showing the ejection outlet plate portion neighborhood which has a plurality of arrays of the ink ejection outlets in the ink jet head according to the first embodiment of the present invention.

FIG. 6 shows an arrangement of an ejection outlet array of an ink jet head of a three-color-integral type according to this embodiment. The inks of the three colors are the cyan, the magenta, and the yellow dye inks, and they are ejected onto the recording material, and are fixed thereon so as to produce a recorded color image. The ejection amounts of the ink differ for every array of the ink ejection outlets disposed at the sides of the ink supply port 102, respectively. Regarding which arrays of the ink ejection outlets at both sides of one ink supply port the large ejection amount of the ink is assigned to, it may be different for every color ink supply port. According to this embodiment, as shown in FIG. 6, in the ejection outlet arrays for the cyan ink C, the large ejection amount is assigned to the ejection outlet array 107RL on the left-hand side of the ink supply port 102, and it is assigned to the right-hand side array of the ink supply port 102 in the ejection outlet array for the magenta ink M, and the same applies to the ejection outlet array for the yellow ink Y. Therefore, the reinforcing rib 20 is provided, in the ejection outlet array for the cyan ink C, on the ejection outlet plate portion 106P on the left-hand side of the ink supply port 102 which is the ejection outlet array 107RL side having a large ejection amount. In the ejection outlet array for the magenta inks M and the ejection outlet array for the yellow inks Y, the reinforcing rib 20 is provided on the ejection outlet plate portion 106P on the right-hand side of the ink supply port 102 which is the side on which the ejection outlet array 107RL having a large ejection amount is formed.

FIG. 6 illustrates the ink jet head in which six arrays of the ink ejection outlets are provided, and the ink ejection amounts of the ejection outlet arrays positioned at both sides are large, wherein the reinforcing ribs 30 are provided for these ejection outlet arrays. In the case that the surface 106S of the opening is covered by the sealing tape, when the recording head is distributed, this sealing tape is removed at the time of the beginning of use. In this case, the opening surface 106S adjacent to the end ejection outlet array tends to receive adhesive resistance of the tape. However, according to this structure, the strength of this portion can be increased.

Even when the refreshing operation for the ejection performance by the suction operation or the wiping is effected, when the surface of the ejection outlet opening is rubbed by the recording material, or even when the external force is applied to the ejection outlet plate portion 106P by the user's inadvertent contact, etc., possible cracking of the surrounding ejection outlet plate portion 106P of the ejection outlet 107 and possible peeling of the ejection outlet plate portion 106P are avoided. Although the heat generating element 103 is used as the energy generating means for discharging the ink which is the recording liquid in this embodiment, the present invention is not limited to this example.

Second Embodiment

Figure 7:
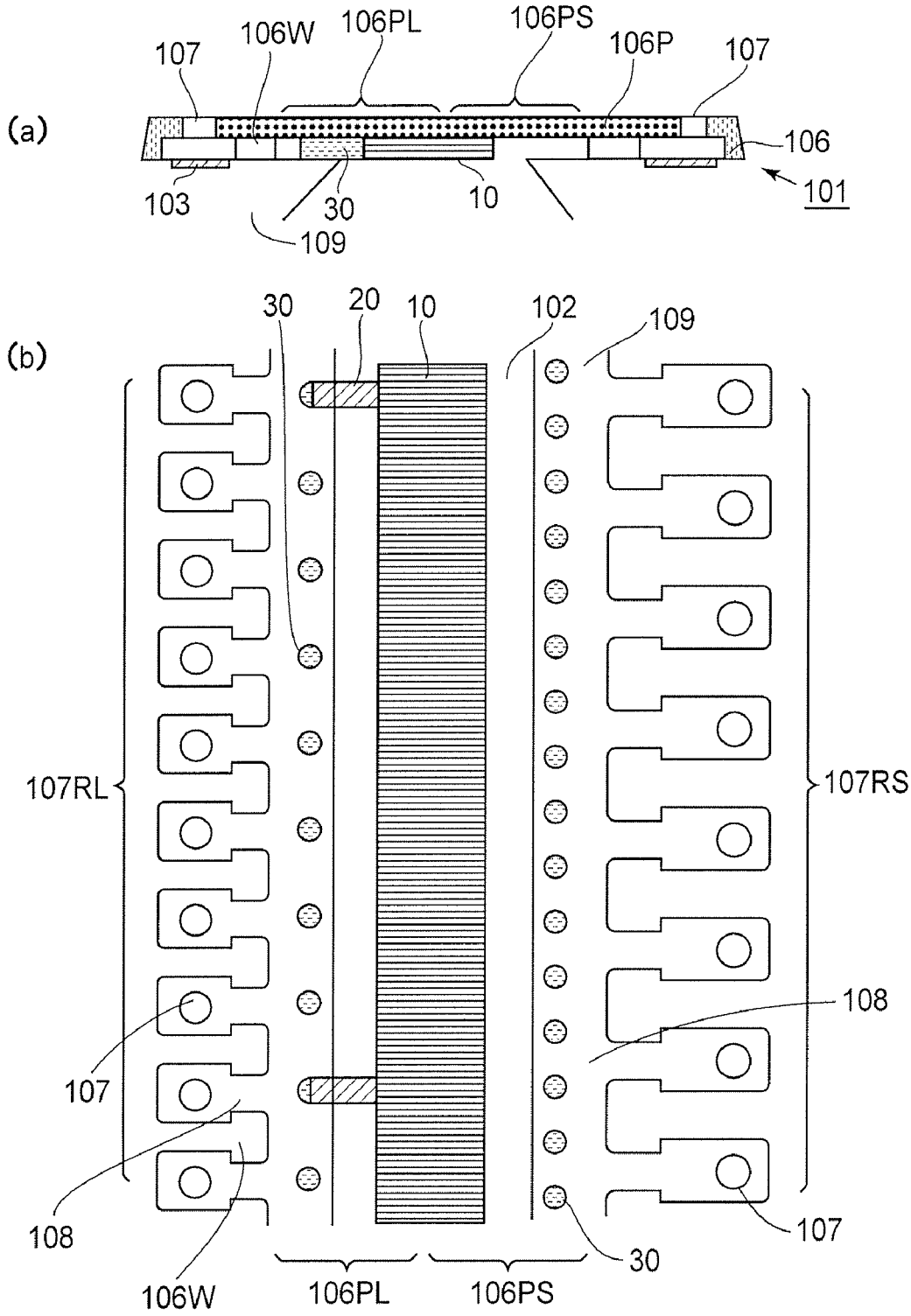
FIG. 7 illustrates a neighborhood of an ejection outlet plate portion of an ink jet head according to the second embodiment of the present invention.
Figure 8:
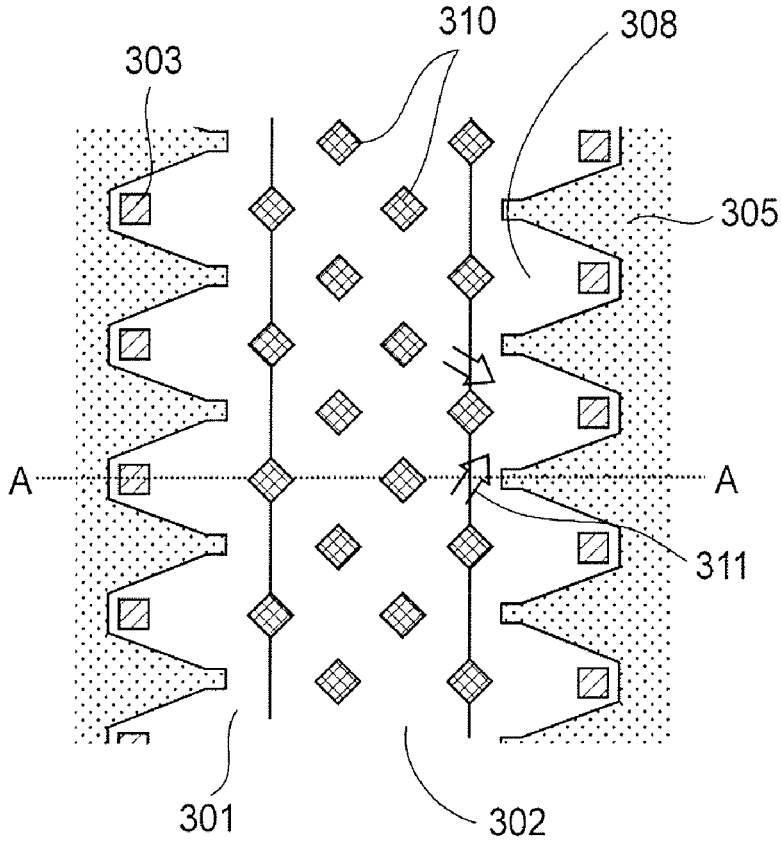
FIG. 8 illustrates a projection provided in an ejection outlet plate in an ink jet head according to the prior art.
Figure 8:
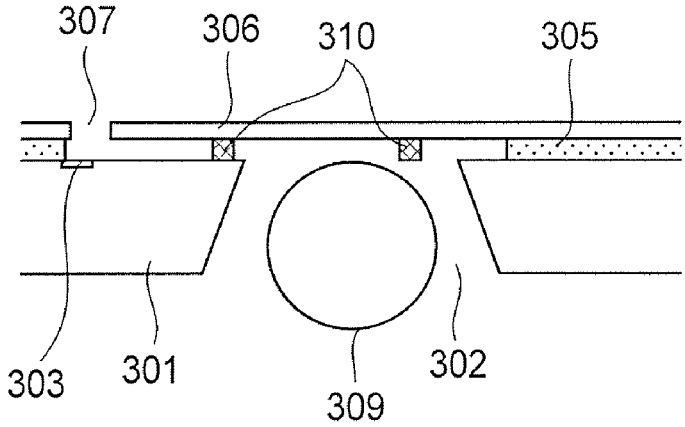
Figure 9:
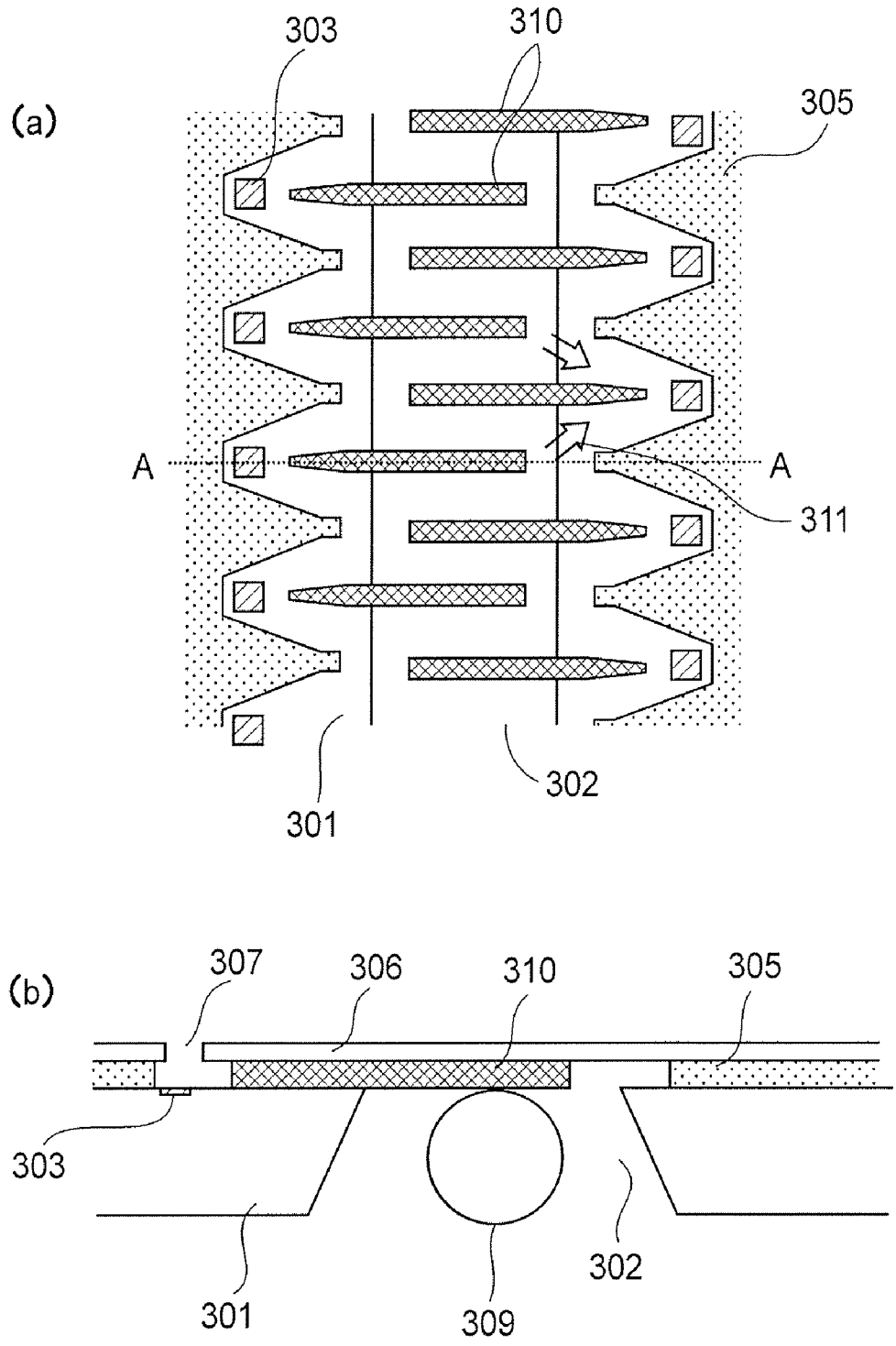
FIG. 9 illustrates another example of the projection provided in the ejection outlet plate in an ink jet head according to the prior art.
Figure 10:
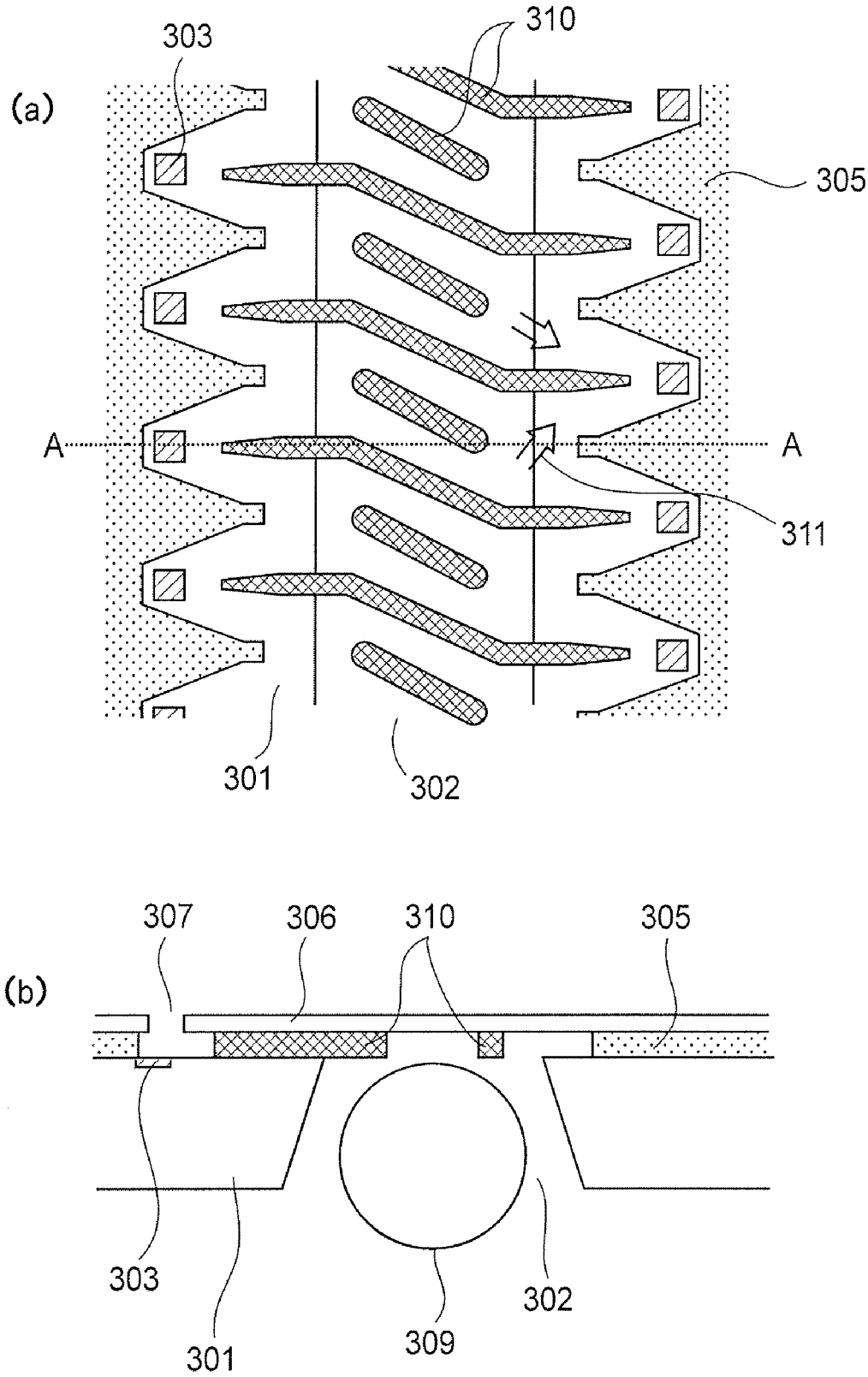
FIG. 10 illustrates a further example of the projection provided in the ejection outlet plate in an ink jet head according to the prior art.

Referring to FIG. 7, the second embodiment of the present invention will be described. With respect to this embodiment, the different points from the first embodiment will mainly be described. In the wiring structure of this embodiment, the several hundreds of ink ejection outlets 107 in the one ejection outlet array are grouped into sets of 8 ejection outlets (8 heat generating elements 103) disposed continuously, wherein the number of the heat generating elements 103 simultaneously driven is one within each group.

Since the fundamental structure shown in FIG. 7 is the same as with the first embodiment, the detailed description thereof is omitted for simplicity. As shown in FIG. 7, the heat generating elements 103 which are the ejection energy generating elements are disposed at both sides with respect to the direction of the extension of the ink supply port 102. In the ejection outlet array 107RL having a large ink ejection amount (5 picoliters), the reinforcing ribs 20 integral with the beam-like projections 10 are extended toward the ink passage 108 at every interval corresponding to eight ejection outlets. The seven columnar projections 30 are provided between adjacent reinforcing ribs 20, respectively. From the viewpoint of the improvement in the rigidity of the ejection outlet plate portion 106P, a wide reinforcing rib 20 is preferable, and a thick columnar projection 30 is preferable. However, as for the size and the configuration of the reinforcing rib 20 and the columnar projection 30, it is desirable to constitute them so that a large flow resistance, as has been described hereinbefore, will not be provided against the ink supply. In this embodiment, the width of the reinforcing rib 20 and the diameter of the columnar projection 30 are 13 μm. In the structure in which such reinforcing members are arranged in the ink path from the ink supply port 102 to the heat generating elements 103, it has been confirmed that the ink ejection performance is less influenced than in the structure of the first embodiment. As to the array of the ink ejection outlets 107RS having a small ink ejection amount (1-2 picoliters), such a reinforcing rib 20 is not provided, but two such columnar projections 30 are provided for one ink ejection outlet.

Also in this embodiment, the beam-like projection 10 is provided in the ejection outlet plate portion 106P which bridges across the ink supply port 102 without contacting with the silicon substrate 109. The portion which is not contacted to the silicon substrate 109 of the ejection outlet plate portion 106P is supported by the reinforcing rib 20 extended from the beam-like projection 10 and the columnar projection 30 projected from the ejection outlet plate portion 106P. With such a structure, the strength of the portion, in the ejection outlet plate portion 106P forming the ink ejection outlet 107, which is not contacted to the silicon substrate 109 and therefore which is the vulnerable and tends to be destroyed by the external force, increases.

The reinforcing ribs 30 are disposed at the positions corresponding to above described groups, respectively. In other words, they are disposed at the intervals corresponding to the number of the ink ejection outlets 107 of one group. In this embodiment, the reinforcing rib 30 is disposed correspondingly to the heat generating element 103 disposed at the end of each group. By this correspondence between the reinforcing rib 30 and the group, the number of the heat generating elements 103 driven by one actuation between adjacent reinforcing ribs 30 is one at the maximum. Therefore, the distribution of flow path resistance can be made uniform in the entire ejection outlet arrays at the time of ink filling to the ink passage 108, while suppressing the flow path resistance by the reinforcing rib 30.

While the invention has been described with reference to the structures disclosed herein, it is not confined to the details set forth herein, and this application is intended to cover all such modifications or changes as may come within the purpose of the improvements or the scope of the following claims.

This application claims priority from Japanese Patent Application No. 109910/2006 filed Apr. 12, 2006, which is hereby incorporated by reference herein.

What is claimed is:

1. An ink jet head comprising:

a plurality of energy generating elements for generating energy for ejecting ink droplets;

a substrate including an ink supply port extending in a direction, said energy generating elements arranged on both sides of said ink supply port;

a plurality of ink ejection outlets provided corresponding to said energy generating elements, said ink ejection outlets including an array of large ink ejection outlets for ejecting a relatively large ejection amount of ink, the array of large ink ejection outlets being disposed at one side with respect to said ink supply port, and an array of small ink ejection outlets for ejecting a relatively small ejection amount of ink, the array of small ink ejection outlets being disposed at another side with respect to said supply port;

an ejection outlet plate portion provided on said substrate so as to be opposed to said ink supply port;

a plurality of ink flow paths for fluid communication between said ink supply port and said ink ejection outlets, respectively;

a beam-like projection projected from said ejection outlet plate portion toward said ink supply port so as to oppose said ink supply port, wherein said beam-like projection extends in a longitudinal direction of said supply port; and reinforcing ribs integral with said beam-like projection, wherein said reinforcing ribs extend from said beam-like projection toward the array of large ink ejection outlets and contact said substrate, and said reinforcing ribs are provided only at the one side with respect to said ink supply port.

2. An ink jet head according to claim 1, wherein said reinforcing ribs are arranged at regular intervals along a direction of arrangement of said energy generating elements, wherein columnar projections projected from said ejection outlet plate portion toward said substrate are provided in portions between adjacent ones of said reinforcing ribs.

3. An ink jet head according to claim 1, wherein said reinforcing ribs are arranged at regular intervals along a direction of arrangement of said energy generating elements, wherein a centerline of an extension of each of said reinforcing ribs passes through a center of flow of incoming ink.

4. An ink jet head according to claim 1, wherein a plurality of ink supply ports are provided in said substrate, wherein said ejection outlets of the ink ejection outlet array disposed at each of outermost positions have a larger ink ejection amount than that of said ejection outlets in another array.

5. An ink jet head according to claim 1, wherein said reinforcing ribs are provided for groups of said ejection outlets which are simultaneously actuatable, respectively.

6. An ink jet head according to claim 5, wherein said reinforcing ribs are arranged at the same intervals as a number of said energy generating elements contained in one of said groups.

* * * * *